US005779434A

United States Patent [19]

De Long

[11] Patent Number: 5,779,434

[45] Date of Patent: Jul. 14, 1998

[54] PUMP MOUNTED THRUST BEARING

[75] Inventor: Robert De Long, Alberta, Canada

[73] Assignee: Baker Hughes Incorporated, Houston, Tex.

[21] Appl. No.: 796,154

[22] Filed: Feb. 6, 1997

[51] Int. Cl.[6] ..... F04D 1/06; F04D 13/06; F04D 29/66

[52] U.S. Cl. ..... 415/104; 415/107; 415/112; 415/121.2; 415/169.1; 415/180; 415/199.2; 415/229; 417/365; 417/423.6; 417/423.8; 417/423.12

[58] Field of Search ..... 415/104, 106, 415/107, 111, 112, 96, 121.2, 169.1, 180, 199.1, 199.2, 199.3, 229; 417/423.6, 423.8, 423.12, 365

[56] References Cited

U.S. PATENT DOCUMENTS

| | | | |
|---|---|---|---|
| 1,974,678 | 9/1934 | Lafont . | |
| 2,633,392 | 3/1953 | Luenberger . | |
| 3,171,355 | 3/1965 | Harris et al. . | |
| 3,186,513 | 6/1965 | Dunn et al. | 417/423.12 |
| 3,257,957 | 6/1966 | Tracy | 415/121.2 |
| 3,364,866 | 1/1968 | Sato . | |
| 4,553,909 | 11/1985 | Galais et al. . | |
| 4,668,159 | 5/1987 | Biordo | 415/199.5 |
| 5,160,240 | 11/1992 | Wilson . | |
| 5,195,867 | 3/1993 | Stirling . | |
| 5,203,682 | 4/1993 | Inklebarger . | |
| 5,340,272 | 8/1994 | Fehlau | 415/104 |
| 5,613,831 | 3/1997 | Liegat | 415/229 |

FOREIGN PATENT DOCUMENTS

| | | | |
|---|---|---|---|
| 954656 | 9/1982 | U.S.S.R. | 415/112 |

*Primary Examiner*—Christopher Verdier
*Attorney, Agent, or Firm*—James E. Bradley

[57] ABSTRACT

A thrust bearing assembly for a surface mounted centrifugal pump utilizes the pump liquid for lubrication of a thrust bearing and radial bearings. The thrust bearing mounts to the rearward end of the intake chamber. A communication passage extends between the thrust chamber and the intake chamber. A circulation tube leads from the intake chamber to the rearward end of the thrust chamber. A portion of the water being delivered to the intake chamber is diverted through the circulation tube, where it circulates through the thrust bearing and back to the intake of the pump. The shaft passes through the thrust chamber to an electrical motor. A mechanical seal seals the shaft at the rearward end of the thrust chamber.

20 Claims, 2 Drawing Sheets

PUMP MOUNTED THRUST BEARING

TECHNICAL FIELD

This invention relates in general to centrifugal pumps and in particular to a thrust bearing for a surface mounted centrifugal pump.

BACKGROUND ART

One type of pump for injecting large volumes of liquid into a well is a centrifugal pump. The pump has a large number of stages of impellers and diffusers. The pump is mounted horizontally on the surface and has an intake chamber connected to one end. A shaft extends through the intake chamber to an electrical motor for driving the pump. Rearward thrust is created due to the action of the pump. This thrust is absorbed by a thrust bearing assembly mounted between the intake and the electrical motor.

The prior art thrust bearing assembly has a thrust runner and stationary bearing located within a housing. The bearings are located within a chamber that is filled with a clean lubricating oil. A seal seals around the shaft at the point where it passes from the intake chamber into the lubricant chamber. It is important to avoid contamination of the oil by the water being pumped. While these types of pumps work very well, the seal between the intake chamber and the thrust bearing housing must be replaced from time to time due to wear. This can be a difficult task because it requires removing the entire thrust bearing assembly from the pump. During the removal time, the pump will be down and cannot be operated.

DISCLOSURE OF INVENTION

In this invention, the thrust bearing assembly does not utilize oil as a lubricant. Rather, the thrust chamber is in communication with the intake chamber and utilizes the fluid being pumped as a lubricant. A communication path extends between the intake chamber and the thrust bearing chamber. Preferably, means exist for causing the well fluid to circulate through the thrust bearing and back into the intake.

In one embodiment, this circulation means comprises a circulation tube that extends from the intake to the rearward end of the thrust chamber. A small pump stage is located in the thrust bearing to induce flow from the rearward end through the stationary bearing, thrust runner and back through the communication passage to the intake chamber. Also, if needed, a separator can be located in the circulation line to separate solids from the liquid being circulated through the thrust bearing. In one embodiment the separator is a cyclone separator, having a clean outlet leading to the rearward end of the thrust chamber. A solids outlet leads back to the intake to return solids and other heavier materials that might otherwise damage the bearings.

BEST MODE FOR CARRYING OUT THE INVENTION

Figure 2:
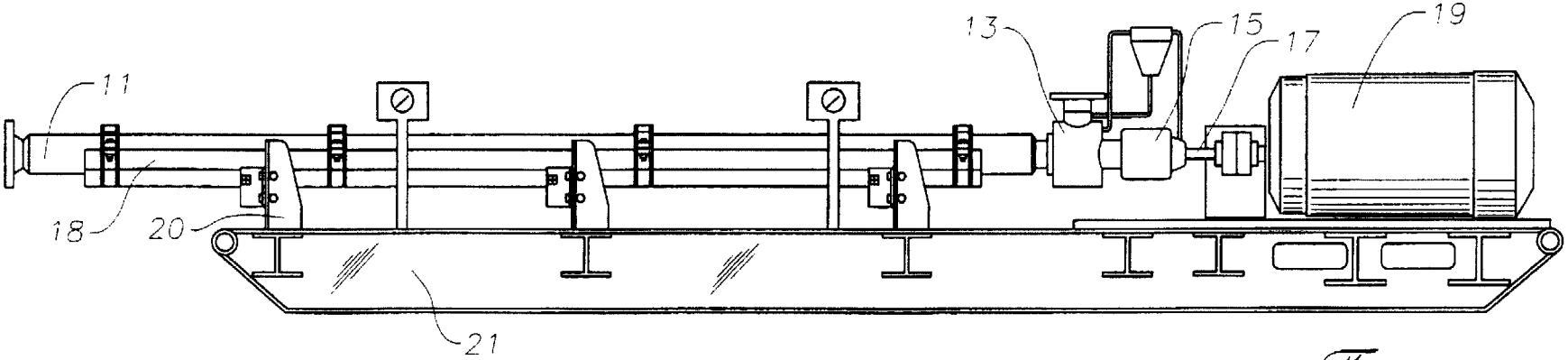
FIG. 2 is a side schematic view illustrating a pump assembly in accordance with this invention.

Referring to FIG. 2, the surface booster pump assembly of this invention includes a centrifugal pump 11. An intake chamber 13 is mounted to the rearward end of pump 11 for supplying a liquid to be pumped by pump 11. A thrust chamber 15 bolts to the rearward end of intake chamber 13. Shaft 17 is coupled to a conventional electrical motor 19, which rotates shaft 17 to drive pump 11. Thrust chamber 15 absorbs rearward directed thrust on pump shaft 17 caused by the action of pump 11. Pump 11 is rigidly clamped to a support channel 18, which in turn is mounted to a skid 21 by a plurality of legs 20. The clamps and support channel 18 prevent rotation of the housing of pump 11. Thrust chamber 15 is cantilever supported by pump 11 in the embodiment shown. It is possible to have a non rigid support on thrust chamber 15, which could be used if needed to reduce deflection of pump 11 and intake housing 13.

Figure 1A:
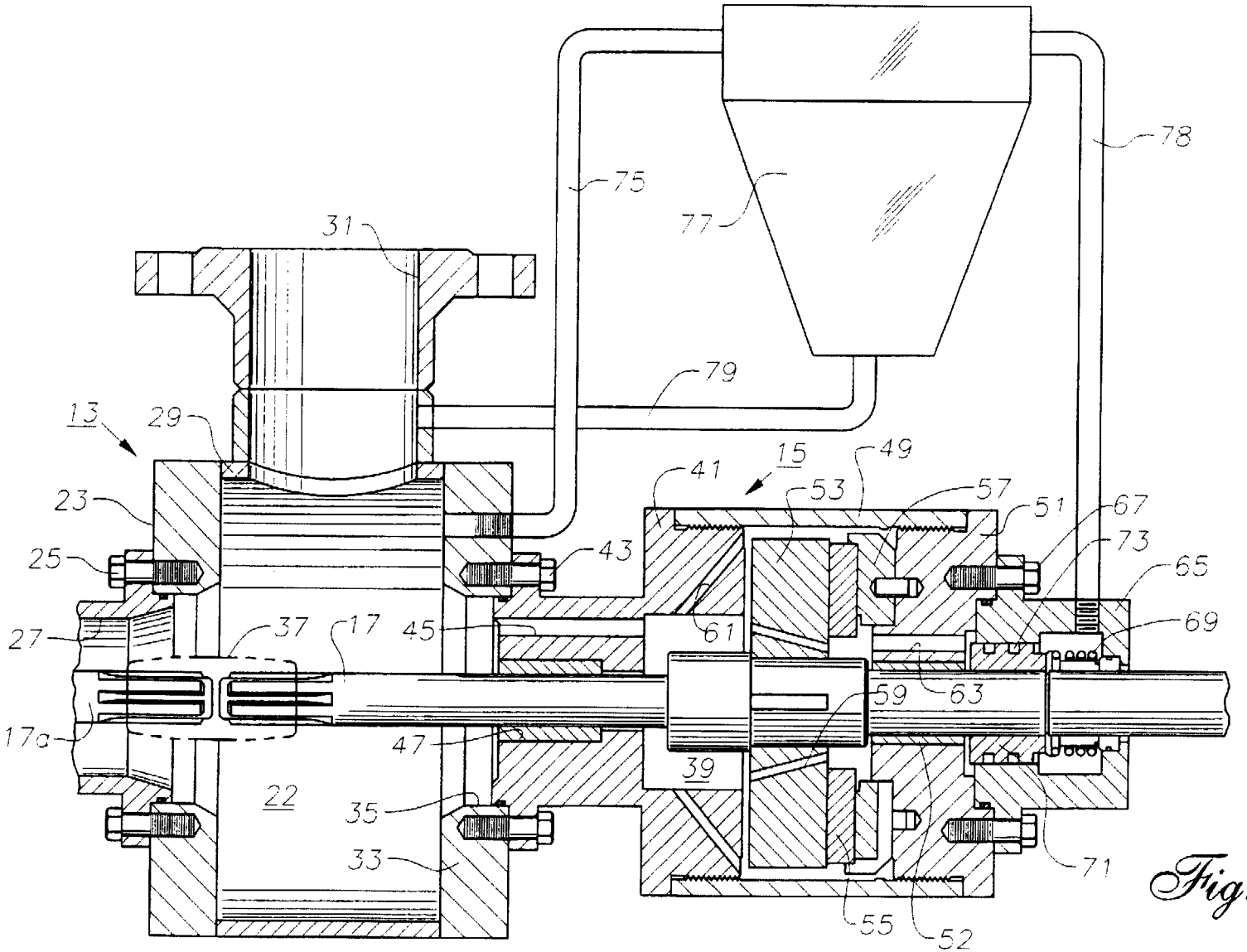
FIGS. 1A and 1B comprise a vertical sectional view of a portion of a pump and thrust bearing constructed in accordance with this invention.

Referring to FIG. 1A, intake chamber 13 has a cavity 22 and a forward wall 23 secured by bolts 25 to the intake end 27 of pump 11. Intake chamber 13 has a sidewall 29 that has an inlet 31 which is adapted to be connected to a conduit (not shown) for delivering a source of fluid to be pumped. Often, the fluid comprises water that has been produced from an oil well and separated at the surface for pumping into an injection well. A rearward wall 33 forms the rearward end of intake chamber 13 and is parallel to forward wall 23. Shaft 17, which extends through intake chamber 13, has a forward portion **17*a* that extends through pump 11. A coupling 37 connects forward portion 17*a* to the remaining portion of shaft 17. Rearward wall 33 has a hole 35 through which shaft 17 passes. Hole 35 is considerably larger in diameter than shaft 17**.

Thrust chamber 15 has an internal cavity 39 and a head 41 on the forward end which secures to rearward wall 33 by bolts 43. Head 41 has a communication passage 45 that extends through it for communicating fluid between thrust chamber cavity 39 and intake chamber cavity 22. Head 41 also has a central axial hole which receives a radial bearing or bushing 47 for supporting shaft 17.

A cylindrical sleeve 49 is secured to head 41. A base 51 is secured to the rearward end of sleeve 49, being spaced axially from head 41. Base 51 also has a bushing 52 through which shaft 17 passes. A thrust runner 53 is mounted to shaft 17 for rotational and axial movement with shaft 17. Thrust runner 53 is a cylindrical disk having a finished surface on its rearward side. A stationary thrust bearing 57 contains a plurality of pads 55 on is forward side. Pads 55 slidingly engage thrust runner 53. Thrust runner 53 and pads 55 are of hard wear resistant materials such as ceramic. A plurality of passages 59 extend through thrust runner 53, fluid communicating the portion of cavity 39 on the rearward side of thrust runner 53 with that on the forward side. Passages 53 are inclined relative to the axis, with the outlets farther radially outward than the inlets. A plurality (only one shown) of passages 63 extend through base 51.

A seal housing 65 is secured by bolt 67 to the rearward side of base 51. Seal housing 65 is a part of thrust chamber 15 and is in fluid communication with cavity 39. A conventional mechanical seal 69 locates at the rearward side of seal housing 65 for sealing around shaft 17 where it passes through seal housing 65. Mechanical seal 69 may be of a rotary face type, having ceramic bearing surfaces and biased by a spring.

A circulation means is employed to circulate a small portion of the liquid being supplied to pump 11 through thrust chamber 15. One type of circulation means comprises of a small pump stage 71 located within seal housing 65. Pump stage 71 is rigidly mounted to shaft 17 for rotation therewith. Pump stage 71 has a helical groove 73 formed on its exterior. The outer periphery of pump stage 71 is closely spaced to or in sliding engagement with a passage in seal housing 65. Rotation of shaft 17 and pump stage 71 causes it to operate as a screw pump, pumping liquid from seal housing 65 through passages 63, 59 and 45 back to the intake cavity 22.

A circulation tube 75 serves to supply to seal housing 65 a small portion of the liquid being supplied to intake chamber 13. In the embodiment shown, circulation tube 75 extends from intake chamber rearward wall 33 to a cyclone separator 77. Cyclone separator 77 is of a conventional type used to separate lighter and heavier components. Cyclone separator 77 has a clean outlet tube 78 that extends to the rearward end of thrust chamber 15 at seal housing 65. Tube 78 delivers the lighter or cleaner components of the liquid being supplied to tube 75. Cyclone separator 77 has a solids discharge tube 79 which leads from the lower end back to inlet 31 upstream from the entrance to circulation tube 75. Solids discharge tube 79 discharges heavier components such as solids separated by cyclone separator 77.

Figure 1B:
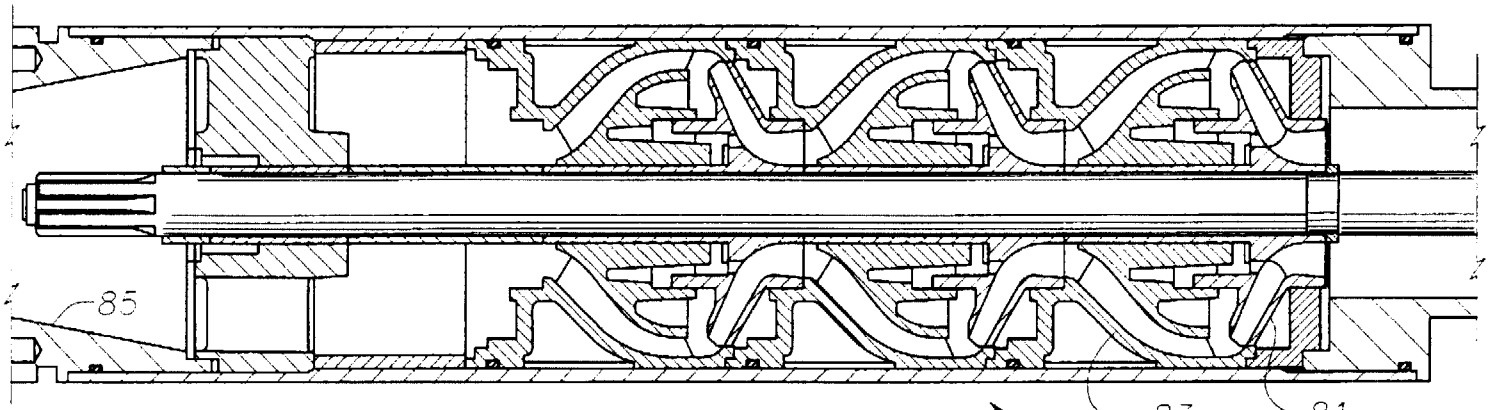

Referring to FIG. 1B, pump 11 is conventional. It contains a large number of stages, each having an impeller 81 and a diffuser 83. Pump 11 pumps liquids out a discharge end 85. In operation, motor 19 will rotate shaft 17 to drive pump 11. Thrust created by impellers 81 transfers to shaft 17. This thrust passes to thrust runner 53 (FIG. 1A), which in turn transmits the thrust through thrust pads 55 and thrust bearing 57 to base 51. This thrust transfers to the housing of pump 11 because thrust chamber 15 is mounted to the housing of pump 11 through intake chamber 13.

A portion of the water supplied to inlet 31 passes through circulation tube 75 to cyclone separator 77. Heavier solids discharge out line 79 back to inlet 31. The lighter, cleaner portion of the water passes through line 78 to seal housing 65. Pump stage 71 pumps the water through passage 63 into the space surrounding bearing pads 55 and thrust bearing 57 for cooling. The centrifugal action of the rotation of thrust runner 53 forces water to the outside of the thrust runner for cooling. The water flows out through communication passage 45 to cavity 22 of intake chamber 13. This portion of the water merges with the other water being supplied to inlet 31 to be pumped by pump 11.

In the event that replacement of mechanical seal 69 is needed, it may be readily replaced. The coupling of shaft 17 to motor 19 is detached. Then seal housing 65 is removed by unscrewing bolts 67. This allows ready access to mechanical seal 69.

The invention has significant advantages. Utilizing water as a cooling fluid avoids the necessity for having a mechanical seal located between the thrust chamber and intake chamber. As a result, the only mechanical seal required will be the one located at the rearward end of the thrust chamber. This mechanical seal is readily accessed for replacement. There is no chance of contaminating the bearings with water because the bearings are constructed to be cooled by water, rather than by oil.

While the invention has been shown in only one of its forms, it should be apparent to those skilled in the art that it is not so limited but is susceptible to various changes without departing from the scope of the invention. For example, rather than a pump element in the seal housing, positive pressure for circulating through the thrust chamber could be provided by connecting the circulation tube upstream end to the centrifugal pump at a selected distance from the intake.

I claim:

1. An apparatus for absorbing thrust created by a centrifugal pump which has an intake on one end and a discharge on another end, comprising:

an intake chamber;

means for securing the intake chamber to the intake of the pump;

a thrust chamber extending from a rearward side of the intake chamber, having an annular stationary thrust bearing in said thrust chamber;

a shaft extending through the thrust chamber and thrust bearing, having a rearward end adapted to be coupled to a motor and a forward end adapted to be coupled to the pump;

a thrust runner mounted to the shaft in sliding engagement with the thrust bearing for absorbing thrust applied to the shaft;

the intake chamber having an inlet adapted to be connected to a source of fluid and which is located forward of the thrust chamber for supplying the fluid to the intake of the pump; and a fluid communication path between the intake chamber and the thrust chamber.

2. The apparatus according to claim 1, wherein the communication path extends between the rearward side of the intake chamber and a forward side of the thrust chamber.

3. The apparatus according to claim 1, wherein the communication path extends between the rearward side of the intake chamber and a forward side of the thrust chamber; and wherein the apparatus further comprises:

a circulation tube connected to the thrust chamber rearward of the thrust bearing, the circulation tube adapted to be connected to the source of fluid for circulating the fluid from the thrust chamber through the communication path to the intake chamber where it merges with the fluid being supplied by the source to the pump.

4. The apparatus according to claim 1, wherein the communication path extends between the rearward side of the intake chamber and a forward side of the thrust chamber; and wherein the apparatus further comprises:

a circulation tube connected to the thrust chamber rearward of the thrust bearing, the circulation tube being connected to the intake chamber; and a circulation pump in communication with the circulation tube for circulating fluid from the circulation tube through the thrust chamber, through the communication path, and back to the intake chamber where it merges with the fluid being supplied by the source to the intake of the pump.

5. The apparatus according to claim 1, wherein the communication path extends between the rearward side of the intake chamber and a forward side of the thrust chamber; and wherein the apparatus further comprises:

a circulation tube connected to the thrust chamber rearward of the thrust bearing, the circulation tube being connected to the intake chamber; and a circulation pump having a helical flight mounted in the thrust chamber to the shaft for rotation therewith for circulating fluid supplied from the circulation tube through the thrust chamber, through the communication path, and back to the intake chamber where it merges with the fluid being supplied by the source to the intake of the pump.

6. The apparatus according to claim 1, further comprising:

a circulation tube extending exterior of the thrust chamber and connected between the thrust chamber and the intake chamber for circulating to the thrust chamber a portion of the fluid being supplied by the source to the intake chamber; and a separator connected to the circulation tube for separating solids in the fluid flowing through the circulation tube.

7. The apparatus according to claim 1, wherein the communication path extends between the rearward side of the intake chamber and a forward side of the thrust chamber; and wherein the apparatus further comprises:

a circulation tube connected between the thrust chamber and the intake chamber for circulating to the thrust chamber a portion of the fluid being supplied by the source to the intake chamber; and a cyclone separator connected into the circulation tube for separating solids in the fluid flowing through the circulation tube, the separator having a solids discharge which leads directly back to the intake chamber, bypassing the thrust chamber.

8. The apparatus according to claim 1, wherein the communication path comprises a port extending through a forward side of the thrust chamber.

9. A pump assembly, comprising in combination:

a centrifugal pump which has an intake on a rearward end and a discharge on a forward end;

an intake chamber having a rearward end and a side wall, the side wall having an inlet adapted to be connected to a source of fluid;

means for securing the intake chamber to the rearward end of the pump;

a thrust chamber extending rearward from the rearward end of the intake chamber, having a stationary thrust bearing therein;

a motor located rearward of the thrust chamber;

a shaft extending through the thrust chamber, having a rearward end coupled to the motor and a forward end coupled to the pump for driving the pump;

a thrust runner mounted to the shaft in rotary engagement with the thrust bearing for absorbing thrust applied to the shaft; and circulation means for circulating a portion of the fluid from the source through the thrust chamber and into the intake chamber for merging with the fluid being directly supplied to the intake of the pump.

10. The assembly according to claim 9, wherein the circulation means comprises:

a circulation tube leading to the thrust chamber rearward of the thrust bearing; and a communication port extending from the thrust chamber through the rearward end of the intake chamber.

11. The assembly according to claim 9, wherein the circulation means comprises:

a circulation tube leading from the intake chamber to the thrust chamber to deliver a portion of the fluid in the intake chamber to the thrust chamber;

a circulation pump in communication with the circulation tube for pumping fluid from the circulation tube through the thrust chamber; and a communication port extending from the thrust chamber through the rearward end of the intake chamber to return fluid flowing through the thrust chamber back to the intake chamber.

12. The apparatus according to claim 9, wherein the circulation means comprises:

a circulation tube connected to the thrust chamber rearward of the thrust bearing, the circulation tube being connected to the intake chamber;

a circulation pump having a helical flight mounted in the thrust chamber to the shaft for rotation therewith for circulating fluid supplied from the circulation tube through the thrust chamber, through the communication path, and back to the intake chamber where it merges with the fluid being supplied by the source to the intake of the pump; and a communication port extending from the thrust chamber through the rearward end of the intake chamber to return fluid flowing through the thrust chamber back to the intake chamber.

13. The assembly according to claim 9, wherein the circulation means comprises:

a circulation tube leading from the intake chamber to the thrust chamber to deliver a portion of the fluid in the intake chamber to the thrust chamber;

a circulation pump in communication with the circulation tube for pumping fluid from the circulation tube through the thrust chamber;

a communication port extending from the thrust chamber through the rearward end of the intake chamber to return fluid flowing through the thrust chamber back to the intake chamber; and separation means connected into the circulation tube for removing any solids that may be present in the fluid in the circulation tube.

14. The assembly according to claim 9, wherein the circulation means comprises:

a circulation tube leading from the intake chamber to the thrust chamber to deliver a portion of the fluid in the intake chamber to the thrust chamber;

a communication port extending from the thrust chamber through the rearward end of the intake chamber to return fluid flowing through the thrust chamber back to the intake chamber; and a cyclone separator connected into the circulation tube for removing any solids that may be present in the fluid in the circulation tube, the separator having a discharge conduit which delivers the solids back to the intake chamber, bypassing the thrust chamber.

15. The assembly according to claim 9, wherein the thrust runner has a plurality of passages therethrough for passage of the fluid flowing through the thrust chamber.

16. A pump assembly, comprising in combination:

a centrifugal pump which has an intake on a rearward end and a discharge on a forward end;

an intake chamber having a forward end, a rearward end, and a side wall, the side wall having an inlet adapted to be connected to a source of fluid;

means for securing the forward end of the intake chamber to the rearward end of the pump;

a thrust chamber extending rearward from the rearward end of the intake chamber, having an annular stationary thrust bearing therein;

a motor located rearward of the thrust chamber;

a shaft extending through the thrust chamber and to the motor, the shaft being coupled to the pump for driving the pump;

a thrust runner rigidly mounted to the shaft in rotary engagement with the thrust bearing for absorbing thrust applied to the shaft;

a communication port in the rearward wall of the intake chamber leading to the thrust chamber; and a circulation tube having an upstream end in communication with a portion of the fluid being supplied from the source and a downstream end connected to the thrust chamber; and positive pressure means for causing flow of the fluid through the circulation tube, thrust chamber and out the communication port into the intake chamber.

17. The assembly according to claim 16, wherein the positive pressure means comprises:

a circulation pump in communication with the fluid in the circulation tube.

18. The assembly according to claim 16, wherein the positive pressure means comprises:

a circulation pump having a helical groove and mounted in the thrust chamber to the shaft for rotation therewith.

19. The assembly according to claim 16, wherein the positive pressure means comprises:

a circulation pump having a helical groove and mounted in the thrust chamber to the shaft for rotation therewith; and wherein the assembly further comprises:

a cyclone separator connected into the circulation tube for removing any solids that may be present in the fluid in the circulation tube, the separator having a discharge conduit which delivers the solids back to the intake chamber, bypassing the thrust chamber.

20. A method of absorbing thrust created by a centrifugal pump which has an intake chamber secured thereto, comprising:

mounting to the intake chamber a thrust chamber which has a stationary thrust bearing in said thrust chamber, a shaft extending through said thrust chamber, and a thrust runner rigidly mounted to the shaft in rotary engagement with the thrust bearing;

coupling a rearward end of the shaft to a motor and a forward end of the shaft to the pump for driving the pump;

supplying fluid to the intake chamber, rotating the shaft with the motor, and absorbing thrust on the shaft with the thrust runner and thrust bearing; and circulating a fractional portion of the fluid being delivered to the intake chamber through the thrust chamber for cooling and from there into the intake chamber for merging with the fluid being supplied to the pump.

* * * * *